United States Patent [19]

Reist

[11] Patent Number: 4,730,820

[45] Date of Patent: Mar. 15, 1988

[54] COMB FILE FOR FLAKE/SCALE FEEDING OF PRINTED PRODUCTS

[75] Inventor: Walter Reist, Hinwil, Switzerland

[73] Assignee: Ferag AG, Hinwil, Switzerland

[21] Appl. No.: 880,824

[22] Filed: Jul. 1, 1986

[30] Foreign Application Priority Data

Aug. 22, 1985 [CH] Switzerland ..... 3611/85

[51] Int. Cl.[4] ..... B65H 5/30

[52] U.S. Cl. ..... 270/55; 198/423; 198/456; 270/58; 271/198; 271/221

[58] Field of Search ..... 270/55, 154, 58; 271/198, 221, 240, 204; 198/456, 493, 423, 440–442, 836, 698, 627, 694

[56] References Cited

U.S. PATENT DOCUMENTS

| | | | |
|---|---|---|---|
| 2,907,443 | 10/1959 | Rosso | 198/442 |
| 3,212,414 | 10/1965 | Kuratle | 198/423 |
| 3,529,168 | 9/1970 | Guggisberg | 198/423 X |
| 4,007,824 | 2/1977 | Reist | 198/423 |
| 4,076,231 | 2/1978 | Kutzner et al. | 270/54 |
| 4,248,413 | 2/1981 | Fox | 270/58 |
| 4,381,108 | 4/1983 | Newsome | 198/456 |
| 4,533,132 | 8/1985 | Wangermann | 270/55 |
| 4,667,809 | 5/1987 | Raybuck | 198/456 |

FOREIGN PATENT DOCUMENTS

| | | | |
|---|---|---|---|
| 90355 | 6/1982 | Japan | 198/440 |

*Primary Examiner*—E. H. Eickholt

*Attorney, Agent, or Firm*—Walter C. Farley

[57] ABSTRACT

The apparatus for filing or ordering a scale flow of folded, flat printed products from a rotary printing press has sliding teeth formed into a filing comb arranged on both side of the scale flow and fixed to tooth supports and with, in each case, at least one sliding tooth engaging to the left and right of a printed product in the scale flow behind its fold. The tooth supports are fixed to rotatable chains arranged to the right and left of the scale flow. One drum runs laterally along side the scale flow, so that said engagement is permitted. An equal number of filing combs is fixed to the rotary chains and run in each case around two sprockets, at least one being a driving sprocket, the spacing of two teeth on the same rotary chain determining the new scale spacing. The driving sprockets are controlled synchronously to one another with a single rotary speed, so that between the sliding teeth and the running scale flow a speed difference is obtained permitting a displacement of the printed product within the scale flow. The printed product displacement leads to a reduction of the spread or scatter of the scale spacing.

25 Claims, 7 Drawing Figures

FIG. 5
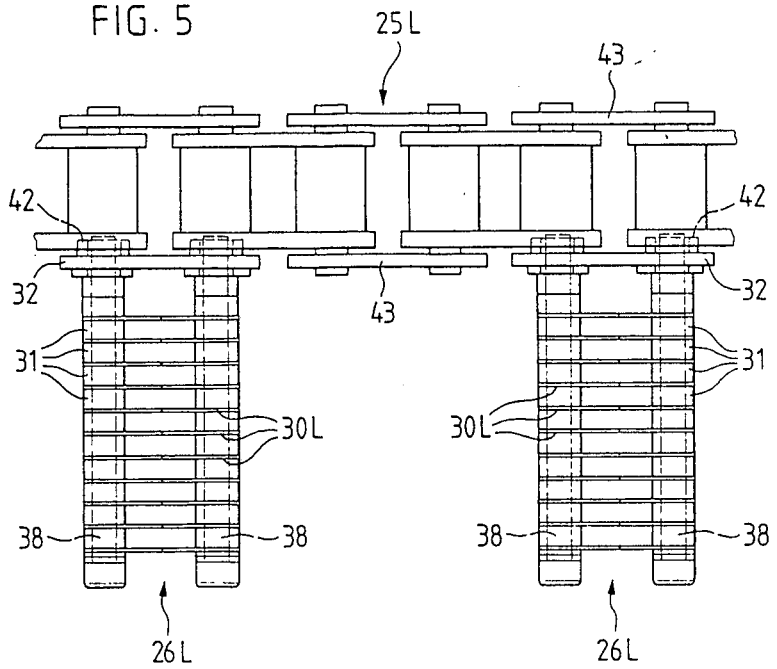
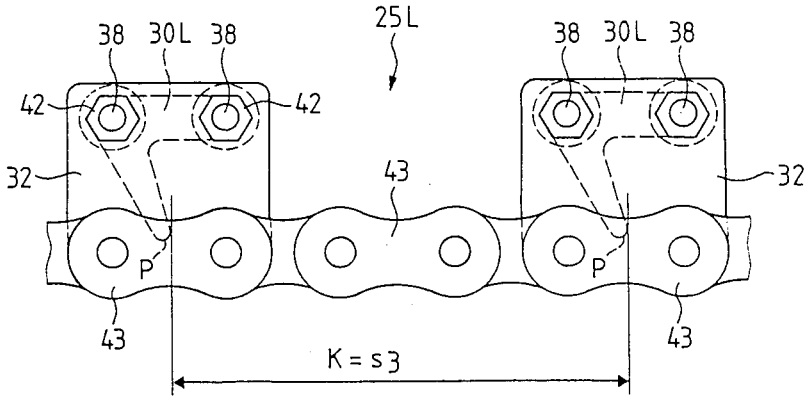
FIG. 6

COMB FILE FOR FLAKE/SCALE FEEDING OF PRINTED PRODUCTS

The present invention is in the field of printing, technology and relates to an apparatus for filing or putting in order a flake/scale flow of printed products.

BACKGROUND OF THE INVENTION

In fast production processes an attempt is generally made to bring about some order in the production flow so as to facilitate subsequent manipulations of the matter produced and which might not otherwise be possible. In the case of flat products, such as those obtained in printing, a filing or order system has been established, which is referred to as a scale flow as a result of the characteristic nature of the imbricated positioning of the printed products. This scale flow is organized at the time when the product is issued or delivered, in that, in the context of rotary printing, a so-called delivery turning star superimposes in staggered manner the printed copies at the outlet from the rotary press. The delivery rate is typically 50,000 to 100,000 copies per hour and consequently constitutes high speed production.

The conveying away of the products in the form of an ordered flake or scale flow is presently an established, well controlled technology. It is also suitable for the high speed field and is more particularly used where further processing is necessary, or more specifically where the order brought to the scale flow is a prerequisite for the further processing which will be accomplished using the following machine stations along a production path.

In the case of a processing rate of 15 to 20 printed copies per second, a fault leading to subsequent disordered accumulation has a decisive effect and can in extreme cases lead to the process having to be stopped. Among the various preventative measures for preventing faults, this may even lead to the correction of the scale flow parameters, particularly the scale spacing. Measures in this connection are known, e.g., the use of gravity for producing an ordered movement within the scale flow. For this purpose, the incoming scale flow is moved against gravity in a rising ramp and the flat copies which tend to slide back are raised by means of a mechanically guided pushing or sliding means. Such a scale flow ordering or filing means is generally a fixed apparatus part, which takes over the scale flow and passes it on in ordered manner. Such an apparatus part must be planned into the conveying system and, after installation, has a fixed location within the process.

However, what is sought is a "portable" high speed scale flow file, which can operate over the high-end range of the processing speed and which has high or very high operational reliability due to the simplicity of its operation. The portability serves to ensure that the file can be integrated at the desired point into the process in the case of existing plants and that as a result optimum operation is possible in new planned plants. In the high-end power range, faults lead to particularly difficult situations, so that the requirements for operational reliability are particularly high.

SUMMARY OF THE INVENTION

The object of the present invention is to provide such a scale flow file.

Briefly described the invention includes an apparatus for adjusting the relative positions of like portions of elements in a scale flow of flat, folded products moving in a predetermined direction comprising the combination of first and second sets of equal numbers of shift blades on opposite sides of the scale flow, and first and second means for movably supporting the shift blades of said first ad second sets, respectively, such that the blades in each set are longitudinally spaced apart relative to the direction of scale flow and individual ones of the blades are opposite each other and operate in pairs, each said means including a support for each said shift blade for moving its supported blade longitudinally along said scale flow such that pairs of said blades can engage and longitudinally shift an individual products, and drive means for driving said support at a selected longitudinal speed different from the speed of movement of said scale flow.

In another aspect, the invention includes a method of controlling the operation of an apparatus for adjusting the spacing between like portions of elements in a scale flow of flat, folded products wherein the products are placed in the scale flow with spacings of the like portions deviating from a predetermined spacing pattern and are moving in a predetermined direction, the apparatus being of the type comprising first and second sets of equal numbers of shift blades on opposite sides of the scale flow, and first and second means for movably supporting the shift blades of the first and second sets, respectively, such that the blades in each set are longitudinally spaced apart relative to the direction of scale flow and individual ones of the blades are opposite each other and operate in pairs, each said means including a support for each shift blade for moving its supported blade longitudinally along the scale flow such that pairs of the blades can engage and longitudinally shift an individual product, and drive means for driving said support at a selected longitudinal speed different from the speed of movement of said scale flow, the method comprising selecting and setting the speed of the drive means and longitudinal spacing of the shift blades relative to the flow speed and average product spacing in the scale flow to accomplish one of a scale spacing displacement and a phase displacement.

BRIEF DESCRIPTION OF THE DRAWINGS

The invention is described in greater detail hereinafter relative to an embodiment of the scale flow file according to the invention and with reference to the drawings, wherein:

FIG. 5 is a side elevation, in greater detail, of the comb file with two filing combs;

FIG. 6 is a top plan view in detail of the structure of the use of auxiliary units on the scale flow file in accordance with the present invention.

DESCRIPTION OF THE PREFERRED EMBODIMENT

Figure 1:
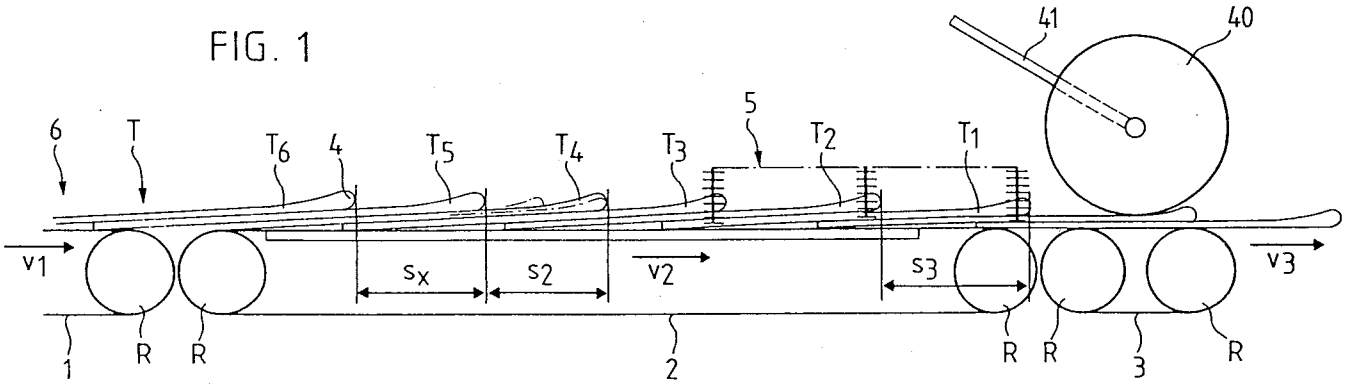
FIG. 1 is a diagrammatic side view of an embodiment of the present invention.
Figure 3:
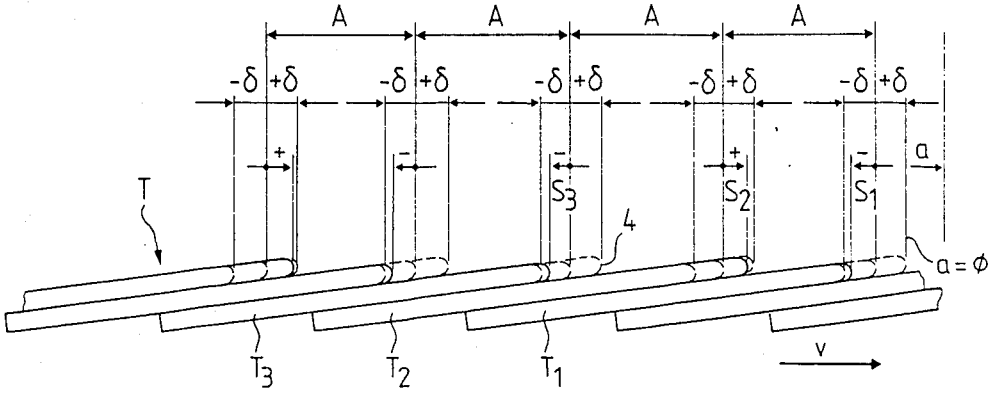
FIG. 3 is a detail from a scale flow with respect to a given timing grid, by which the layer of a scale element is statistically scattered.

The diagrammatic representations of FIGS. 1 and 3 mainly serve to explain the apparatus part of the invention and the operation thereof. In FIG. 1 the scale flow is in the direction of arrow T with the individual scale flow elements, e.g., printed copies T1 to T6, guided on a conveyor belt 1 with a speed v1 to a conveyor belt 2 with a speed v2. In this case, conveyor belt 2 is part of the file and on it the staggered, superimposed printed copies T1, T2, T3 are moved in a planned manner by a comb filing or ordering means 5. The printed copies are generally one or more sheets folded one or more times and each has a fold 4. The latter is used for filing or adjusting the printed copies according to the invention. The scale flow elements or printed copies brought into the new order are subsequently transferred to a further conveyor belt 2 having a speed v3. The scale spacing sx is ordered, in this case, from the supplied scale spacing s2 to a new scale spacing s3, the scale spacing sx being measured between individual folds. Another way of fixing the scale spacing will be discussed hereinafter relative to FIG. 3. In the new ordered or filed form, the scale flow is moved away on a conveyor belt 3 with speed v3 unequal to v1 and unequal to v2. On increasing the scale spacing, the virtual scale flow length increases, whereas when the spacing is reduced, it is also reduced. The varying speed of the virtual length of the scale flow is compensated by the different running speeds of the conveyor belts. As is shown, the conveyor belts are endless belts running over rollers R.

Figure 4:
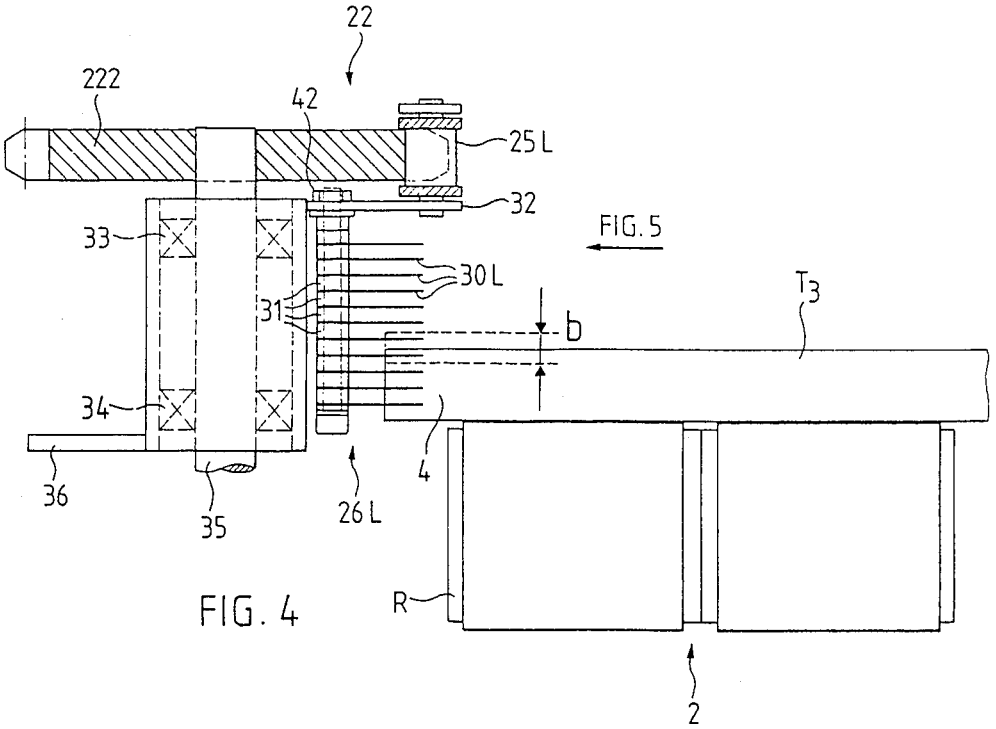
FIG. 4 is a schematic end elevation, in partial section, of one comb file of a comb file pair as seen in the scale flow direction.

A comb file 5, which will be described in greater detail relative to FIGS. 4, 5 and 6 is linked with the conveyor 2. The individual scale flow elements Tx are detected in the incoming scale flow with the aid of a counting station 6. If this count is mathematically linked with the accurate scale spacings sx and the scale flow rate v, this leads to a scale flow time cycle, which is synchronized with the master time cycle of the printing press, i.e. the delivery time cycle of the individual printed products from the press, to within a statistical deviation. The complete production conveying means is matched to this time cycle, i.e., the connecting in of equipment, such as e.g. the scale flow file according to the invention, always takes place in accordance with the given timing pattern, so that each plant part runs synchronously with each other and trouble-free product transfer is ensured. FIG. 1 shows above conveying away belt 3 a pressure roller 40 pivotably arranged on a roller arm 41 and which permits a problem-free transfer of the newly ordered scale flow on belt 3.

Figure 2:
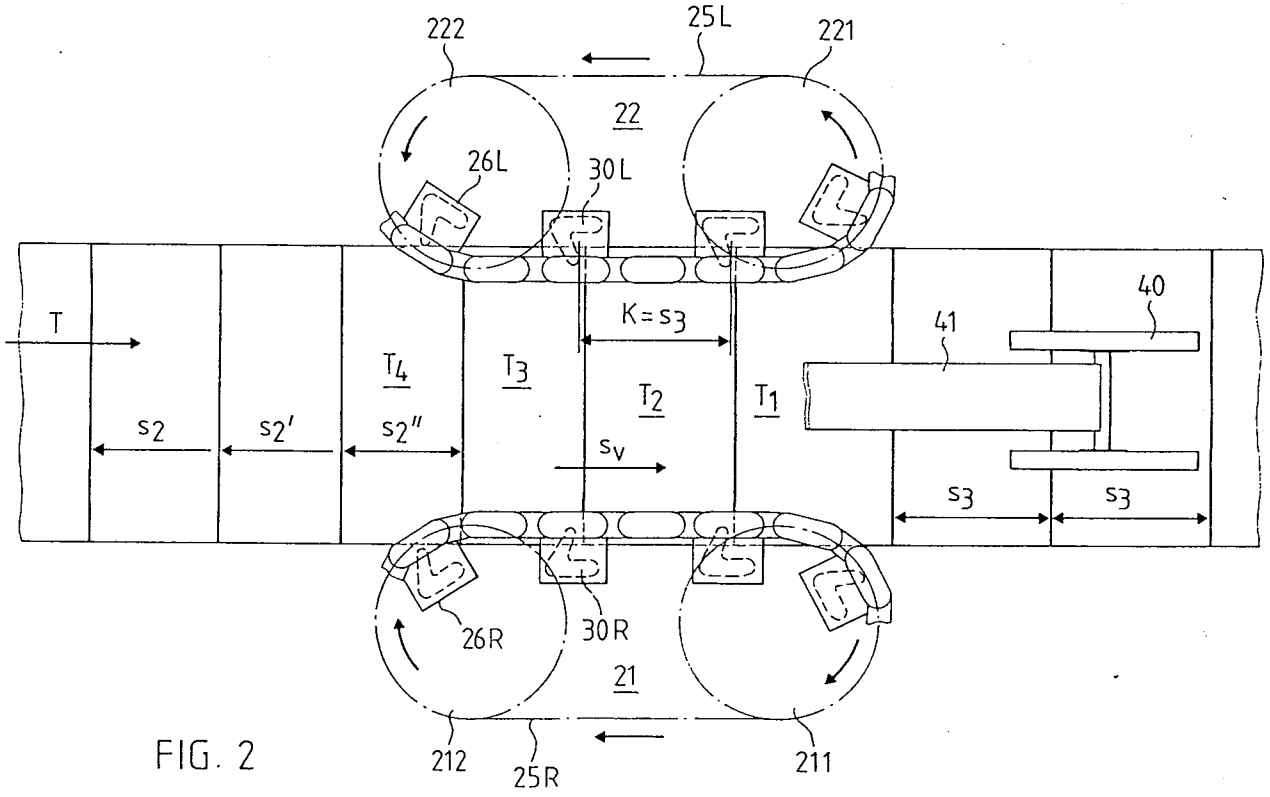
FIG. 2 is a plan view of the same embodiment.

FIG. 2 diagrammatically shows the apparatus of FIG. 1 viewed from above. FIG. 2 does not show the incoming belt 1. Laterally of conveyor belt 2 is provided a comb filing means 5 with two comb files 21, 22, of mirror-image construction, which will be discussed in greater detail hereinafter. They behave like left and right hands, whose thumbs advance the printed copies in the scale flow (in the direction of the arrow). The comb files 21,22 have a chain 25L running around sprockets 221,222 for the left and another chain 25R on sprockets 211, 212 for the right and to which are fixed a plurality of comb-like assemblies, namely the hands or combs 26L for the left and 26R for the right which operate as shift blades. To simplify the representation, only those assemblies on the scale flow, i.e., located in the forward-moving side are shown. The two oppositely rotating comb files move the combs which are boomerang-shaped in plan view, and which can also be compared with a hand having spread out thumbs, longitudinally along the scale flow. They are arranged in such a way that the comb tips (thumbs) can project laterally into the scale flow. FIG. 2 clearly shows how the shift blades or combs 26 of the comb files 21,22 swing into the lateral region of the scale flow, then follow in a linear, parallel or slightly upwardly sloping manner the scale flow in its running direction and are finally deflected in such a way that they again swing out of the scale flow. The combs are running faster than the belt speed v2 and therefore can grip the printed matter, e.g., scale flow element T3 on the inside of fold 4 (FIG. 1), and draw or pull this to the desired scale spacing S3, before swinging out again at scale flow element T1, which is conveyed at the speed v3 of conveying-away belt 3 for transfer to the latter.

Considering FIG. 2, the scale spacing of the incoming scale flow is designated S2, S2′ and S2″, i.e., three different scale spacings. The stochastic deviations are a function of the delivery turning star and possibly also the conveying distance or section and the like and can reach a spread or scatter making it difficult or even impossible for subsequent processing by equipment parts bound to fixed cycle times. If the scale spacing spread exceeds a certain amount, in certain circumstances the process speed must be reduced to assure trouble-free operation or a scale flow file must be used.

FIG. 3 is very helpful in representing the scale tolerance. The position of the scale flow elements is determined or measured by a given timing grid with the timing spacing A. This timing grid is binding for all the participating units and is directly synchronous with the delivery from the rotary printing press. The reference point of the printed product with respect to the grid is the front part of the fold of each scale flow element, whose deviation from the timing grid can be looked upon in the same way as a phase error. In practice, the printed products are individually taken up by means of clamps form the scale flow. If the clamps operate with the timing spacing A, it is apparent that the printed product fold may only differ from the expected time and position within a given tolerance range, so that the individual take-up from the scale flow is ensured. Such a tolerance range is given in FIG. 2 as $\pm\delta$ (delta) and the deviations $-S1$, $+S2$ and $-S3$ are assumed for the scale flow elements T1, T2, T3. Although such spreads or scatters are to be looked upon as random, they are not uninfluenced by characteristics of the delivery turning star and the conveying means.

According to the invention the scale spacing of the incoming scale flow is always modified in such a way that shift Sx→S3 reduces the spread to the desired amount. This can be as follows: $Smax+a=Sv\rightarrow s3=s2+SV$, Smax being the measure for the maximum spread of the scale spacings in one direction (e.g., in the scale flow running direction) and "a" is an addition or additional shift of from 0 up to a desired value. From this is obtained the displacement length Sc, which in this embodiment is fixed by the spacing of two shift blades or filing combs. With respect to the timing grid A, such a systematic shift up to the tolerance value +delta acts in the same way as a phase displacement by +delta, the scale spacing remaining the same in accordance with timing grid A. If the displacement or shift also varies the scale spacing, preferably increasing the same, then for the same running speed of the scale flow there is a slowed down time cycle with timing grid A+ and in the case of an adequately increased speed, once again a time cycle according to timing grid A. This appears as follows for scale flow T moving in the direction of arrow v as shown in FIG. 3. Scale flow element T1 does not reach the desired position in timing grid A, but is still in the tolerance range. However, scale flow element T2 has gone beyond the desired position in the timing grid A, but is still within the tolerance range. Scale flow element T3 also does not reach the desired position in timing grid A, but is also within the tolerance range. If the given tolerance range is too large for a much higher operating speed then it is necessary to order or file again the scale flow elements in such a way that the new spread is smaller. If, according to the invention, the scale flow elements are moved so far in the scale flow running direction that fold 4 is always located at the point of the +tolerance limit, then the scale elements are rectified in one direction. An addition "a" also leads to the detection of scale flow elements outside the tolerance limit. This rectification procedure for the scale spacing tolerances produces a scale flow, whose scale spacings then have a spread which is dependent only on the comb file.

The scale flow is, so to speak, drawn apart in the represented process of a consequent increase in the scale spacing from S2 to the spacing K of two combs, i.e., s3=s2+Sv=K, as shown in FIG. 2. It moves with its basic speed v1 in the conveying direction, is accelerated relative to conveyor belt 2 in the scale flow file running at the speed v2=v1 and "grows" with a speed Sv/time unit. The growth rate Sv per time unit is superimposed on the basic speed v1. This requires that the conveying speed v3 following the file be higher by the corresponding amount than the conveying speed v1 in front of the file. However, as the number of copies in the scale flow remains the same, the cycle times of the grippers or the like for taking up the printed matter can also remain the same. For the following unit all that has changed is the spread of the scale spacings, which has decreased, which is shown in the precision with which the individual printed copies arrive at a given time at a given place.

The comb files 21,22 will now be described in greater detail relative to FIGS. 4, 5 and 6 and also with the aid of FIG. 2. Viewed from above (FIG. 2), a comb file essentially comprises two synchronous sprockets 211,212, or 221,222 with endless chain means 25R or 25L to which the combs 26R or 26L are fixed. To ensure the synchronism of the engaging comb pairs, there must be a completely slip-free transfer of the driving forces and this requirement is fulfilled by a positive chain engagement. In this embodiment, there are eight combs per chain revolving means (four in each case being shown), which are arranged with the reciprocal spacing K, which corresponds to the new scale spacing S3, i.e., K-S3. As stated hereinbefore, the addition "a" is established by the fixed arrangement of the combs. In the case of a differently constructed apparatus, the spacing K can be made variable, or combs are spaced in accordance with timing grids and there is only one displacement in the sense of a systematic phase displacement with $c1=v2-v3$. However, these are merely different embodiments of the apparatus and operating procedure.

The two comb files are moved synchronously in the direction of the arrow in such a way that the combs of two files move in pairs in the direction of the scale flow T. The angular shape of the combs now permits the lateral engagement of in each case two comb tips behind the same fold of a folded printed product, such as shown at T4, T3, and T2. The speed of the chain revolving means to which the combs are fixed is higher than the scale flow speed due to the increase in the scale spacing (also for a phase displacement), as stated hereinbefore. When the comb pivoting about the sprocket engages the printed product on both sides in the scale flow, e.g., at T4 the product is accelerated after the engagement of the comb teeth behind the fold (with a jerk) and is drawn by a desired portion out of the scale formation, so that as stated hereinbefore the spread of the scale spacings can be eliminated. As shown in FIG. 2 the incoming scale flow T with the different scale spacings S2, S2' and S2'' located in a spread is ordered to the new scale spacing $S3=(S2 \text{ mean})+Sc$ with $Sc=Smax+a$, so that the spread is minimized at S3. The conveying of the newly formed scale flow with the scale spacing S3 advantageously takes place at a correspondingly increased speed, so that the cycle times given in the process can be retained.

FIG. 4 shows the left-hand comb file 22 viewed in the running direction. A number of stacked comb teeth 30L held in spaced manner with one another by means of spacers 31 to form a comb 26L are fixed in non-rotary manner to an endless chain 25L running over two sprockets 221, 222 with the aid of fastening plate 32. The spindle 35 of sprocket 222 or the other sprockets is mounted in a conventional manner, the use of two ball bearings 33,34 being shown here. A retaining device 36 is used for fixing the sprockets to a support structure in comb file 22. Comb pairs 26L,26R, whereof only comb 26L is shown in FIG. 4, are so laterally arranged on product T3 that in the case of different fold heights b of the printed product supplied on conveyor belt 2 with conveyor rollers R, one or more sliding teeth 30 of a comb 26L, 26R can engage behind fold 4. It is naturally also possible to use a comb with a single sliding tooth and to adjust the working height of said sliding tooth to the product, i.e., to its fold height b. The use of the combs 26 with a plurality of sliding teeth 30 automatically detects any change in the fold height and no adjustment is necessary, so that appropriately in each case several sliding teeth 30 are used. The latter are approximately 1 mm thick and have blunt edges. The reciprocal spacing of the sliding teeth is preferably between 4 and 10 mm, as a function of the type of printed product.

FIG. 5 shows two filing combs 26L from the side, or from the right when related to FIG. 4. It is possible to see the tooth stack of the comb, whose individual sliding teeth 30L are placed on two retaining mandrels 38 between the aforementioned spacers 31 to prevent rotation thereof. The two retaining mandrels 38 are screwed to a fastening plate 32 by screws 42 and said plate s fixed in non-rotary manner to endless chain 25L, which is here in the form of a roller chain. It is clear that the represented solution for the comb filing means according to the invention merely represents a preferred embodiment and that other similar constructions with means for the active displacement of the scale flow elements in the scale flow could also fulfil this function.

FIG. 6 shows the way in which the combs or teeth stacks can be fixed to the endless chain, it being a plan view of FIG. 5. It particularly more precisely shows the form or more correctly the proportions of the comb teeth 30 with contact point P, which is the engagement point of the moving teeth on the printed product. Advantageously, the fastening plate 32 is such that it simultaneously can replace the outer side bar of the roller chain and consequently forms part of the latter. With this type of fastening, it is clear that the sliding tooth spacings K have a minimum modulus and cannot be randomly spaced from one another. The sliding tooth spacing K is the same as the newly ordered scale spacing, in this case K=S3. This newly ordered scale spacing is not critical, because with the variably adjustably conveying away speed v3 the scale flow time cycle can be adjusted in accordance with the master system time cycle.

The displacement of the scale flow elements within the scale flow requires a relative movement of the element to be moved and the moving scale flow. This relative movement is brought about by the filing combs moving faster than the scale flow. If the comb teeth e.g., have the spacing of the timing grid A, as a result of the faster moving combs there is a phase displacement and the scale spacing remains in the case of a minimized spread thereof as in the supplied scale flow. In this case there is no need for a change to the conveying-away speed and it is the same as the conveying-in speed. A correction defect then only occurs at a single scale spacing and the scale flow runs on with a systematically modified phase. This phase displacement can then be imparted to the other units, so as to synchronize the sytem again. This possibility means that the comb filing means according to the invention can be used at any point in the scale flow. Thus, it is clearly portable and need not have an additional conveyor belt 2 and/or a different or optionally variable conveying away speed. The comb filing means can be placed on an existing belt.

If in the discussed embodiment there are three conveyor belts, belt 1 for the supply belt, belt 2 for the comb file belt and belt 3 for the removal belt with different speeds, e.g., $v1=v2<v3$, this is only for simplicity of representation and explanation. A brief description will now be given of an embodiment in which a single comb file pair 21,22 is integrated into an existing plant and which functions according to the scale spacing change procedure (higher conveying-away than conveying-in speed).

If according to FIG. 4 (or FIG. 2) the two comb files 21,22 are arranged at an intersection, at which the scale flow products are transferred from a feed or supply belt for individual taking up on the gripping clamps of a timing conveyor, then the quasi-lengthening of the scale flow can be compensated by the faster running timing conveyor chain (higher conveying-away speed). A counting or detection means 6, as is diagrammatically shown in FIG. 7, determines the time cycle per unit of time in the case of a known flow rate v1 which can be S2 (mean value) per unit of time. The comb file 21,22 changes S2 to S3 with a modification of the time cycle/-time unit ratio and the number of printed copies remains the same. The new phase position is taken from the comb file and is not changed further by the displacement of the scale flow elements. As a result of the virtual extension of the scale flow due to scale spacing increase, the timing conveyor chain must run faster by the ratio $S3:S2=(S2+Sv):S2=(S2+S2max+a):S2$ in order to take over the same number of printed copies from the comb file. Thus, the quasi-lengthening of the scale flow is compensated.

In a systematic consideration, for eliminating the spread S2, S2′, S2″ of the scale spacings, the scale flow could be slid together by the same amount by means of the delivery turning star as drawn apart according to the invention. Using pragmatic elimination criteria, this variant can be ignored because it is not economic. Compared with the contraction variant, the expansion variant can be realized in a simple, inexpensive and operationally reliable manner, so that preference is given thereto.

FIG. 7 once again shows a feed belt 1, a comb file belt 2 and a discharge or conveying away belt 3. A product counter or detection means 6 and a pressing of fixing roller 40 pivotably fixed to a roller arm 41 at the inlet or outlet of the scale flow portion "limit" the scale spacing transformation zone, i.e., the area in which the scale spacings are modified for reducing the spread. For a relative movement between two flat, partly superimposed printed products, it is necessary to overcome friction forces (static and sliding friction). Although when combs 26R and 26L swing via sprockets 25R and 25L into to the scale flow T, there is a relatively rapid, jerky acceleration, as a function of the material characteristics, it can still be necessary to eliminate or at least reduce the static frictional forces before drawing out the printed product. Known measures are proposed for this and these are diagrammatically shown in FIG. 7. A measure indicated at 60 is the formation of an air cushion between the individual printed copies by blowing in or injecting an air flow at a given angle of inclination (alpha) directly beneath the fold of the printed copy e.g. T3 arriving in the scale flow, so as to decisively reduce or eliminate the friction constants, so that in relative acceleration printed copy T2 is largely separated from the printed copy T3 above it by the intermediate air cushion. An air cushion can also be formed between the printed copies T2 and T1 already in comb engagement. The represented angle of inclination alpha is dependent on the fold shape, the weight of the printed product, its surface characteristics, etc., so that this angle is advantageously experimentally determined and set.

Figure 7:
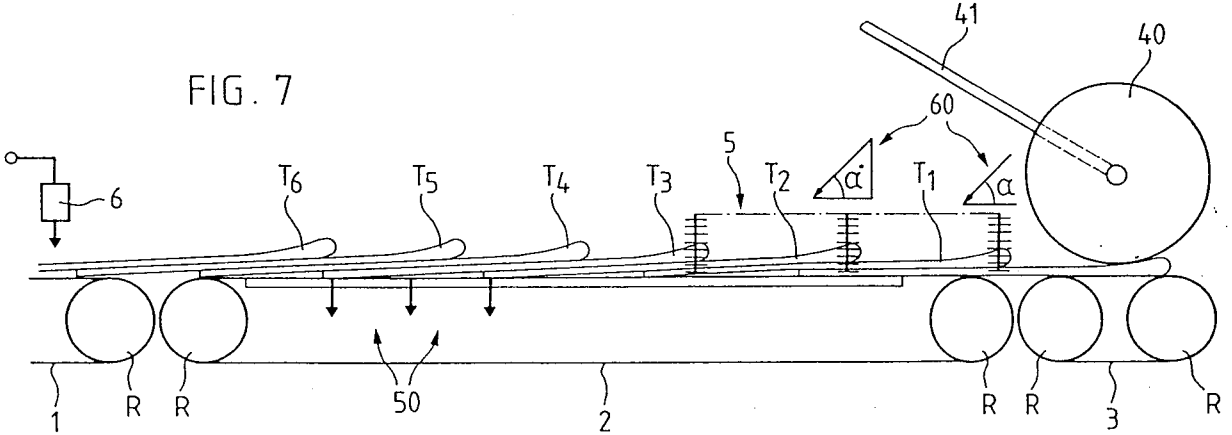

Another measure not specifically shown in FIG. 7 is the reduction of the gravity component by sloping upwards or downwards, in that e.g. the comb file belt 2 is inclined by a given angle. A further measure consists of producing an advantageous effect by introducing energy or vibrations prejudicial to the sticking together of the products. This function can be fulfilled by a vibrator on the comb file belt 2 in the vicinity of the comb file, which is designed and functions in such a way that a "collapse" of the scale flow upstream of and between the comb files is prevented.

By means of reference numeral 50 in FIG. 7 is shown a further measure for preventing the entraining of additional scale flow elements in the case of a jerky movement of the printed product, while retaining the original static friction. As is indicated in FIG. 7 by three downwardly directed arrows under printed copies T6, T5, T4 (acceleration of T3 is to take place with a more or less gentle jerking action) copies which are not in engagement with the comb tooth are held back, e.g. by means of an air pressure difference. This function is fulfilled by a vacuum substrate extending over part of the comb file belt 2 and onto which is pressed part T4, T5, T6 of the printed copies sliding over the same as a result of the pressure difference, whereas printed copy T3 is somewhat drawn out of the combination.

All the measures shown or discussed in conjunction with FIG. 7 are intended to ensure that the printed copies accelerated by comb files 25R, 25L do not modify the scale flow combination in an unplanned manner. However, there is no need to use these measures in all cases. Their use is largely dependent on the characteristics of the printed matter. Advantageously such auxiliary units are arranged on the comb filing means in such a way that they can be connected in when required.

In the method for operating the comb filing means, as well as the means with individual sliding teeth, by a speed setting of the rotary means with the sliding teeth or file combs and/or by a sliding tooth spacing setting of individual teeth or filing combs on the individual rotary means, the means can be set to a scale spacing displacement operation or a phase displacement operation.

The scale spacing displacement operation, the sliding tooth spacing K of the individual sliding teeth or filing combs is chosen larger or smaller than the spacing of a given timing grid A. The rotary means with the sliding teeth or filing combs can then be operated synchronously at a speed formed from the ratio "new ordered scale spacing" S3,K to the mean value of the original scale spacing S2 times the feed speed v1. In the case that the means has an additional autonomous conveying mechanism, it is advantageous if the speed v2 of the conveying mechanism 2 running between the comb filing pair 21,22 is the same as the speed v1 of feed belt 1 and the speed v3 of the conveying away belt 3 is the same as the speed of the rotary means or chain.

For the phase displacement operation, the sliding tooth spacing K of the individual sliding teeth or filing combs is made the same as the spacing of a giving timing grid A. The rotary means with the displacement or sliding teeth or filing combs can then also be operated synchronously with a speed formed from the ratio of the "newly ordered scale spacing" S3,K to the mean value of the original scale spacing S2 times the feed speed v1, which gives the same supply and removal speeds. If the means also has an autonomous conveying mechanism, as described hereinbefore, the speed v2 of the conveying mechanism 2 running between the comb filing pair 21,22 can be made the same as the speed v1 of the feed belt 1 and the speed v3 of the conveying belt 3 the same as the speed of the rotary or chain.

What is claimed is:

1. An apparatus for adjusting the relative positions of like portions of elements in a scale flow of flat, folded products moving in a predetermined direction comprising the combination of first and second sets of equal numbers of shift blades on opposite sides of the scale flow; and first and second means for movably supporting the shift blades of said first and second sets, respectively, such that the blades in each set are longitudinally spaced apart relative to the direction of scale flow and individual ones of the blades are opposite each other and operate in pairs, each said means including a support for each said shift blade for moving its supported blade longitudinally along said scale flow such that pairs of said blades can engage and longitudinally advance an individual product, and drive means for driving said support at a selected longitudinal speed different from the speed of movement of said scale flow.

2. An apparatus according to claim 1 wherein each said support comprises;

and endless chain;

means for mounting said shift blades thereon at spaced locations;

first and second longitudinally spaced sprocket means rotatably mounted for supporting and moving said chain such that one substantially straight portion of said chain moves substantially parallel with the direction of motion of said scale flow and adjacent thereto; and means for driving at least one of said sprocket means, said chain supporting said blades in spaced relationship along said chain so that each blade thereon is moved laterally into said scale flow at the rearward end of said substantially straight portion and laterally out of said scale flow at the forward end of said scale flow, relative to the direction of scale flow motion, as said chain passes around said sprocket means.

3. An apparatus according to claim 2 and further including a plurality of shift blades at each location on said endless chain, means for mounting said blades at each location in a vertically spaced array forming a comb-like structure for engaging product at any of a plurality of vertical levels, each said comb-like structure being mounted on said support for movement as a single blade.

4. An apparatus according to claim 3 and including means for synchronizing the speed and movement of said supports so that said comb-like structures move relative to said scale flow in pairs opposite each other across the scale flow and so that each pair of comb-like structures is pivoted into the scale flow to engage opposite sides of the fold in said folded products.

5. An apparatus according to claim 4 wherein said scale flow further comprises a conveying belt supporting said flat, folded products, said conveying belt passing below and between said means for supporting said shift blades; and an output belt for removing products advanced by said shift blades.

6. An apparatus according to claim 5 and further comprising suction means for holding said products in said scale flow onto said conveying belt.

7. An apparatus according to claim 2 wherein said scale flow further comprises a conveying belt supporting said flat, folded products, said conveying belt passing below and between said means for supporting said shift blades; and an output belt for removing products advanced by said shift blades.

8. An apparatus according to claim 7 and further comprising suction means for holding said products in said scale flow onto said conveying belt.

9. An apparatus according to claim 8 wherein said suction means is longitudinally separated from said means for supporting.

10. An apparatus according to claim 9 and further comprising blowing means for forming air cushions between products.

11. An apparatus according to claim 3 wherein each said endless chain is a roller chain, and each said means for mounting one said shift blade thereon comprises an external chain side bar formed to support at least one shift blade.

12. An apparatus according to claim 2 and further comprising blowing means for forming air cushions between products.

13. An apparatus according to claim 2 wherein each said endless chain is a roller chain, and each said means for mounting one said shift blade thereon comprises an external chain side bar formed to support at least one shift blade.

14. An apparatus according to claim 3 wherein the spacing between and movement of said shift blades defines a moving reference frame relative to which the displacement positions of said products in said scale flow are equivalent to phase displacements, and wherein adjustment of said positions constitutes a phase displacement operation.

15. An apparatus according to claim 3 wherein the longitudinal spacing between said shift blades is greater than the average spacing between folds of said products such that the displacements of the positions of said products in said scale flow are equivalent to a scale spacing displacement operation.

16. An apparatus according to claim 2 wherein the spacing between and movement of said shift blades defines a moving reference frame relative to which the displacement positions of said products in said scale flow are equivalent to phase displacements, and wherein adjustment of said positions constitutes a phase displacement operation.

17. An apparatus according to claim 2 wherein the longitudinal spacing between said shift blades is greater than the average spacing between folds of said products such that the displacements of the positions of said products in said scale flow are equivalent to a scale spacing displacement operation.

18. A method of controlling the operation of an apparatus for adjusting the spacing between like portions of elements in a scale flow of flat, folded products wherein the products are placed in the scale flow with spacings of the like portions deviating from a predetermined spacing pattern and are moving in a predetermined direction, the apparatus being of the type comprising first and second sets of equal numbers of shift blades on opposite sides of the scale flow, and first and second means for movably supporting the shift blades of the first and second sets, respectively, such that the blades in each set are longitudinally spaced apart relative to the direction of scale flow and individual ones of the blades are opposite each other and operate in pairs, each said means including a support for each shift blade for moving its supported blade longitudinally along the scale flow such that pairs of the blades can engage and longitudinally shift an individual product, and drive means for driving said support at a selected longitudinal speed different from the speed of movement of said scale flow, the method comprising selecting and setting the speed of the drive means and longitudinal spacing of the shift blades relative to the flow speed and average product spacing in the scale flow to accomplish one of a scale spacing displacement and a phase displacement.

19. A method according to claim 18 and including selecting the spacing between shift blades to be larger than the average spacing between like portions of the approaching elements in the scale flow whereby a scale spacing displacment operation is performed.

20. A method according to claim 19 and including selecting the speed of the drive means to be proportional to the ratio of the desired scale spacing to the product of the mean value of the incoming scale flow spacing and the incoming scale flow speed.

21. A method according to claim 20 wherein the apparatus includes a feed belt to deliver the incoming scale flow, a conveying belt to receive flow from the feed belt and deliver scale flow to the adjusting apparatus and a removal belt for removing adjusted scale flow, the method including selecting the speed of the conveying belt to be equal to the speed of the feed belt, and selecting the speed of the adjusting apparatus drive means to be equal to the speed of the removal belt.

22. A method according to claim 19 wherein the apparatus includes a feed belt to deliver the incoming scale flow, a conveying belt to receive flow from the feed belt and deliver scale flow to the adjusting apparatus and a removal belt for removing adjusted scale flow, the method including selecting the speed of the conveying belt to be equal to the speed of the feed belt, and selecting the speed of the adjusting apparatus drive means to be equal to the speed of the removal belt.

23. A method according to claim 18 and including selecting the longitudinal spacing between shift blades to be equal to the desired output spacing between like portions of the products, whereby a phase displacement operation is performed.

24. A method according to claim 23 and including selecting the speed of the drive means to be proportional to the ratio of the desired scale spacing to the product of the mean value of the incoming scale flow spacing and the incoming scale flow speed.

25. A method according to claim 24 wherein the apparatus includes a feed belt to deliver the incoming scale flow, a conveying belt to receive flow from the feed belt and deliver scale flow to the adjusting apparatus and a removal belt for removing adjusted scale flow, the method including selecting the speed of the conveying belt to be equal to the speed of the feed belt, and selecting the speed of the adjusting apparatus drive means to be equal to the speed of the removal belt.

* * * * *